United States Patent [19]

Scriven et al.

[11] 4,332,329

[45] Jun. 1, 1982

[54] IMPLOSION COATINGS

[75] Inventors: Roger L. Scriven; Wen-Hsuan Chang, both of Gibsonia, Pa.

[73] Assignee: PPG Industries, Inc., Pittsburgh, Pa.

[21] Appl. No.: 845,103

[22] Filed: Oct. 25, 1977

[51] Int. Cl.[3] ..... H01J 61/35

[52] U.S. Cl. ..... 220/2.1 A; 220/2.1 R; 220/455; 220/457; 358/245; 427/106; 428/425.6

[58] Field of Search ..... 220/2.1 A, 2.1 R, 455, 220/457; 215/DIG. 6; 428/425, 35, 425.6; 358/245, 246, 247; 427/106, 64

[56] References Cited

U.S. PATENT DOCUMENTS

| | | | |
|---|---|---|---|
| 2,293,529 | 8/1942 | Bedford | 220/82 R X |
| 2,706,691 | 4/1955 | Schaefer | 427/106 X |
| 2,719,098 | 9/1955 | Goldman | 220/2.1 R |
| 3,188,227 | 6/1965 | Vodicka et al. | 427/106 |
| 3,265,234 | 8/1966 | McGary, Jr. et al. | 220/2.1 A |
| 3,412,203 | 11/1968 | D'Angelo | 220/2.1 A X |
| 3,471,317 | 10/1969 | Clock | 220/2.1 A |
| 3,715,232 | 2/1973 | Andesse et al. | 220/2.1 R |
| 3,823,032 | 7/1974 | Ukai | 428/216 X |
| 3,864,152 | 2/1975 | Kitamura | 428/441 X |
| 3,889,031 | 6/1975 | Tatsumi et al. | 428/35 X |
| 4,065,589 | 12/1977 | Lenard et al. | 428/441 X |
| 4,093,759 | 6/1978 | Otsuki et al. | 428/425 X |

FOREIGN PATENT DOCUMENTS

| | | | |
|---|---|---|---|
| 1026624 | 4/1966 | United Kingdom | 220/2.1 A |

*Primary Examiner*—Allan N. Shoap
*Attorney, Agent, or Firm*—William J. Uhl

[57] ABSTRACT

An implosion-protected evacuated glass enclosure such as a cathode ray tube or an electric lamp is disclosed. The enclosure is made implosion resistant by depositing on the exterior surface thereof a polyurethane film. The mechanical properties of the polyurethane film result in outstanding glass retention properties when the evacuated glass enclosure implodes.

11 Claims, 2 Drawing Figures

FIG. 1
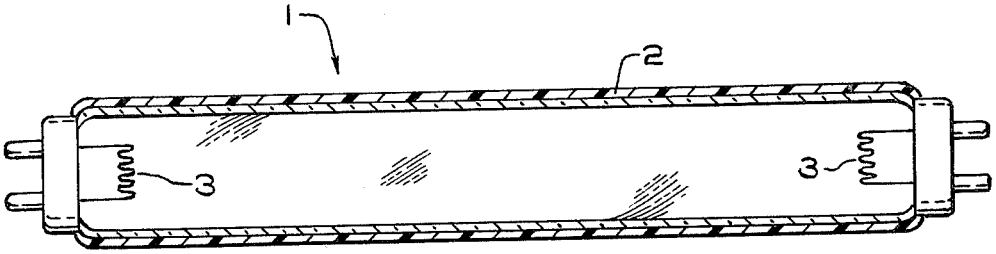
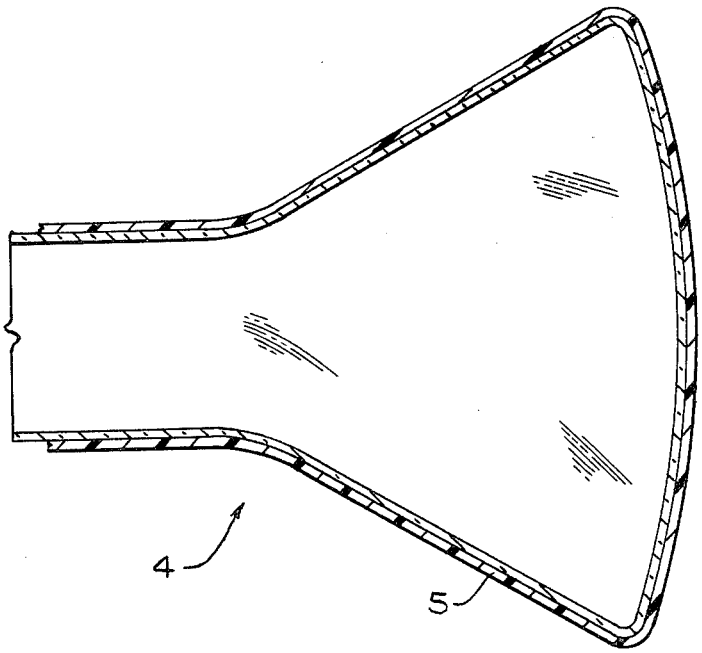
FIG. 2

IMPLOSION COATINGS

BACKGROUND OF THE INVENTION

1. Field of the Invention

The present invention relates to implosion-resistant evacuated glass enclosures and more particularly relates to implosion-protective films for evacuated glass enclosures.

2. Brief Description of the Prior Art

Cathode ray tubes such as are used in television and other electronic display equipment contain a high vacuum. Because of this and because of their large size, breakage and subsequent implosion of television tubes causes the elements of the tube and fragments of glass to fly in all directions with great force.

Attempts have been made to alleviate this danger by providing an auxiliary safety shield consisting of a layer of tempered glass on the front of the tube. This has proven unsatisfactory because the safety shield does not protect the back of the tube which is susceptible to breakage when the tube is being installed and repaired. In addition, breakage from the front destroys the safety shield thereby removing any protection and even contributing to possible injury from flying glass. Also, dust and moisture can collect on the interior surface of the safety shield and on the face of the TV tube creating an optical fog which distorts the picture.

Another means to alleviate the problem of implosion is the use of so-called implosion shields positioned directly on the fact of the television tube. These implosion shields comprise a laminate structure of an outer layer of glass and an inner layer of cured unsaturated polyester resin laminated to the outer face of the television tubes. Unfortunately, television tubes with implosion shields are very costly to make and, in addition, the implosion shield only offers protection to the face of the tube and does not protect the back areas of the tube which are also susceptible to breakage during installing and repair services. An example of the laminate implosion shields is disclosed in U.S. Pat. No. 3,265,234 to McGary, Jr. et al.

Electric lamps are also manufactured under vacuum. The vacuum is of varying degrees and even when not as high, implosion and flying glass is still a danger when the lamps are broken. It is known in the art that electric lamps can be coated with elastomeric silicone resins to make them shatter resistant. Unfortunately, these elastomeric silicone resin coatings are tacky and attract dust which adheres firmly and is not easily removed. This darkens the lamp and reduces its light output. Glossy harder silicone coatings are not effective in reducing shattering.

U.S. Pat. No. 3,715,232 discloses a composite coating for electric lamps comprising a shatter-resistant silicone rubber coating and a hard silicone coating over that to resist the accumulation of dust. Although this multiple coating is reported as providing both shatter resistance and a very glossy surface which will not attract dust, the cost of manufacture is somewhat expensive because the silicones are expensive and two coatings have to be applied.

The present invention overcomes many of the shortcomings of the prior art. The present invention relates to an implosion-resistant polyurethane film which is applied to evacuated glass enclosures such as television tubes and electric lamps. The implosion-resistant film overcomes the problems associated with implosion shields and implosion laminates for television tubes. The film can be easily applied to all areas thereby offering protection not only to the viewing area but also to the area behind the tube. In addition, the film can be applied by conventional techniques such as brushing and spraying with a polyurethane coating composition or by lamination or heat shrinking with a preformed film, thereby providing an economical way to provide implosion protection. The film is non-tacky and can be applied in one layer with good implosion protection thus providing economic incentives over the multiple silicone coatings described in U.S. Pat. No. 3,715,232. Polyurethane coatings also have good abrasion resistance, i.e., resistance to scuffing and scratching that cause distortion in images.

SUMMARY OF THE INVENTION

In accordance with the present invention, an implosion-protected evacuated glass enclosure is provided. The glass enclosure comprises in combination an evacuated glass enclosure and a non-tacky polyurethane film secured to the exterior surface of the glass enclosure. Preferably, the mechanical properties of the polyurethane are such that when a free film of approximately 1.0 to 2.5 mils is subjected to tensile testing according to ASTM D-638-72, the film exhibits a tensile strength of at least 500 pounds per square inch and an elongation of at least about 50 percent. The combination of high tensile strength and elongation of the polyurethane give it excellent glass retaining properties upon implosion.

DESCRIPTION OF THE DRAWING

FIG. 1 is a cross-sectional view of a fluorescent lamp 1 with filaments 3 coated on its exterior surface with a polyurethane coating 2.

FIG. 2 is a side view of a television tube 4 coated on its exterior surface with a polyurethane coating 5.

DETAILED DESCRIPTION

The glass enclosures which are protected with the polyurethane films in accordance with the present invention can be any evacuated glass enclosure. An evacuated glass enclosure is one which contains a pressure less than standard atmospheric pressure and in which implosion will cause a scattering of broken glass. The glass enclosure can be, for example, a cathode ray tube such as a television tube; an electric lamp, such as an incandescent electric lamp, for example, electric light bulbs, flood lamps, spotlights and automobile headlights and fluorescent electric lamps. Also, other glass articles made with a vacuum such as thermos bottles, Dewar flasks, vacuum tubes, evacuated glass containers, laboratory equipment, glass partitions or windows in evacuated chambers and enclosures are examples of evacuated glass enclosures.

The implosion-protective polyurethane film deposited and secured to the exterior surface of the evacuated glass enclosure is prepared from an organic polyisocyanate and an active hydrogen-containing material. The polyurethanes can be thermoplastic or thermosetting in nature and are obtained by reacting the organic polyisocyanate with the active hydrogen-containing material to obtain an ungelled or non-gelled product.

By the term "ungelled" or "non-gelled" is meant the resin is substantially free of crosslinking (before application) and has an intrinsic viscosity less than 4.0 deciliters per gram and preferably lower than 2.0 deciliters per gram, and most preferably within the range of 0.1 to 1.5 deciliters per gram when dissolved in a suitable solvent without depolymerization. The intrinsic viscosity of the polyurethanes can be determined by art-recognized methods such as are described in *Textbook of Polymer Science*, Billmeyer, Interscience Publishers, New York, 1957, pages 79–81.

The organic polyisocyanate which is used in the practice of the invention can be an aliphatic or aromatic polyisocyanate or a mixture of the two. Aliphatic polyisocyanates generally provide better color stability than the aromatic polyisocyanates. Diisocyanates are preferred although higher polyisocyanates can be used in place of or in combination with diisocyanates and/or monoisocyanates. Examples of suitable polyisocyanates are 4,4'-diphenylmethane diisocyanate, toluene diisocyanate, 1,6-hexamethylene diisocyanate, isophorone diisocyanate and 1,2,4-benzenetriisocyanate. Also, isocyanate prepolymers can be used. These are made from reacting a polyisocyanate with an active hydrogen-containing material with an NCO/active hydrogen equivalent ratio greater than one. Particularly preferred isocyanate is 4,4'-methylene-bis(cyclohexyl isocyanate) which is available from E. I. DuPont de Nemours and Company under the trademark HYLENE W®. Isothiocyanates corresponding to the above-described isocyanates can be employed as well as mixed compounds containing both an isocyanate and isothiocyanate group.

The preferred active hydrogen-containing material which is reacted with the isocyanate would include such materials as amines, amino-alcohols, mercapto-terminated derivatives and alcohols including polyols which are most preferred because of the ease of reaction they exhibit with polyisocyanates.

The term "active hydrogen" refers to hydrogens which, because of their position in the molecule, display activity according to the Zerewitinoff Test. Preferred active hydrogens include hydrogen atoms attached to oxygen, nitrogen or sulfur, and thus useful compounds will include those having at least two of these groups (in any combination), —OH, —SH, $$-\underset{|}{NH}$$

and $-NH_2$.

For the development of optimum tensile strength and elongation, the active hydrogen-containing material should be a mixture of both a low and high molecular weight active hydrogen-containing material. Examples of suitable low molecular weight active hydrogen-containing materials are diols and triols having a hydroxyl value of 200 or more, usually within the range of 1500 to 200. Such materials include aliphatic polyols, particularly alkylene polyols containing from 2 to 18 carbon atoms such as ethylene glycol, 1,4-butanediol, 1,6-hexanediol, trimethylolpropane and pentaerythritol.

Examples of high molecular weight active hydrogen-containing materials are polymeric polyols which have hydroxyl values of less than 200, usually within the range of 150 to 30. The most suitable polymeric polyols include polyether polyols including thio ethers, polyester polyols including polyhydroxy polyesteramides and hydroxyl-containing polycaprolactones and hydroxyl-containing acrylic interpolymers with polyether and polyester polyols being preferred.

Examples of polyether polyols are polyalkylene ether polyols which have the following structural formula:

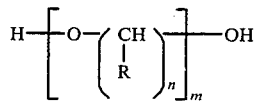

where the substituent R is hydrogen or lower alkyl including mixed substituents, and n is typically from 2 to 6 and m is from 2 to 100 or even higher.

The polyester polyols can be prepared by polyesterification of organic polycarboxylic acids or anhydrides thereof with organic polyols.

The polyols used in preparing the polyester include alkylene glycols, such as ethylene glycol and butylene glycol and trimethylolpropane.

The acid component of the polyester consists primarily of monomeric carboxylic acids or anhydrides having from about 2 to 18 carbon atoms per molecule. Among the acids which are useful are phthalic acid, adipic acid, maleic acid, and other dicarboxylic acids of varying types. Where acids are referred to above, it is understood that anhydrides of those acids which form anhydrides can be used in place of the acid. Also, lower alkyl esters of acids such as dimethyl glutarate can be used.

Besides polyester polyols formed from polybasic acids and polyols, polycaprolactone-type polyesters can also be employed. These products are formed from the reaction of a cyclic lactone such as epsilon-caprolactone with a polyol. Such products are described in U.S. Pat. No. 3,169,945 to Hostettler.

Useful products are also obtainable by substituting a polyesteramide polyol or a mixture of polyesteramide polyols for part or all of the polyester polyol.

Hydroxy-containing acrylic polymers can also be employed. These products are described in U.S. patent application Ser. No. 392,585, filed on Aug. 29, 1973, to Chang et al, and assigned to PPG Industries, Inc., the assignee of the present invention, on pages 5 and 6, the portions of which are hereby incorporated by reference.

The higher molecular weight polymeric polyol component is preferably combined with the low molecular weight polyol described above. It has been found that by blending high and low molecular weight polyols, optimum properties can be obtained in the resultant NCO-containing prepolymer. Preferably the polymeric polyol is present in an amount of 25 to 95 percent by weight based on total weight of the polyol used in preparing the NCO prepolymer, the remainder being the low molecular weight polyol.

The polyurethanes are prepared by techniques well known in the art. Thus, the organic polyisocyanates and active hydrogen-containing materials can be reacted at temperatures of from about 20° to 200° C. for about 0.1 to 40 hours and optionally in the presence of a catalyst such as an organo tin compound. Polyurethanes can be prepared via the so-called one-shot technique in which all the active hydrogen-containing materials are reacted with the organic polyisocyanate or by the prepolymer method in which only part of the active hydrogen-containing materials are reacted to form an NCO prepolymer followed by reacting the prepolymer with the remaining portion of the active hydrogen-containing materials. Usually, when both a polymeric and relatively low molecular weight active hydrogen-containing material are used, the prepolymer method is employed. Usually, the organic polyisocyanate is reacted with a polymeric polyol to form the prepolymer followed by chain extension with the low molecular weight active hydrogen-containing material. The polyurethane can be prepared in the absence or the presence of an inert organic solvent such as ethyl acetate, methyl ethyl ketone, tetrahydrofuran, or N-methyl-2-pyrrolidone, such as is well known in the art. Also, the polyurethane can be prepared in the presence of water. In this reaction, an NCO prepolymer is prepared neat or in organic solvent, the prepolymer dispersed in water and chain extended in water with an active hydrogen-containing material more reactive with NCO groups than water. This preparation is described in U.S. patent applications Ser. No. 582,946 and Ser. No. 583,085, both filed on June 2, 1975, to Scriven and Chang.

As mentioned above, the polyurethanes can be either thermoplastic of thermosetting in nature. Thermoplastic polyurethanes are preferred when it is desired to have the greatest elongation and tensile strength. Thermosetting polyurethanes, although not usually having the preferable high degree of elongation, are preferred when chemical and solvent resistance is desired in the resultant coating. It should be appreciated, however, that the thermosetting polyurethane, although not having the highest degree of adhesion, can still be prepared with relatively high degrees of elongation. The degree of elongation depends on the extent of crosslinking which can be varied over wide limits. Thus, the change from a thermoplastic polyurethane with high elongation to a thermosetting polyurethane with high chemical and solvent resistance can be made gradually and to most any extent depending on the degree of crosslinking employed. Thermoplastic polyurethanes are generally prepared with an NCO/OH ratio of about 1/1 and the reaction conducted essentially to completion to form a high molecular weight thermoplastic product. Thermosetting polyurethanes are generally prepared such that the polyurethane is either NCO-containing or active hydrogen-containing. The polyurethane is then combined with a crosslinking agent which brings about chemical crosslinking after the film is deposited either at room temperature or elevated temperature depending upon the particular coating system used. In the case where the polyurethane is NCO-containing, the curing agent can be an active hydrogen-containing material such as a polyol or a polyamine. In the case where the polyurethane is active hydrogen-containing, the curing agent can be a blocked isocyanate, an aminoplast resin, a phenolic resin or, in the case where the active hydrogens are amino hydrogens, an epoxy-containing organic material. Curing systems of this sort are known in the art and further reference in not considered to be necessary. Suitable aminoplast, phenolic and isocyanate curing agents are described in U.S. Pat. No. 3,919,351, column 5, line 34, to column 6, line 49, which is hereby incorporated by reference.

A liquid diluent is usually present with the polyurethane. By diluent is meant a solvent or non-solvent which is volatile and is removed after the polyurethane is applied and is needed to reduce viscosity sufficient to enable forces available in simple coating techniques, such as by brushing or spraying, to spread the coating to controllable, desired and uniform thicknesses. Also, diluents assist in substrate wetting, resinous component compatibility and coalescence or film formation. Generally a diluent is present in the composition in amounts of about 20 to 90 and preferably 50 to 80 percent by weight based on total weight of the diluent and polyurethane, although more or less diluent may be employed depending upon the particular coating application. Examples of suitable liquid diluents for polyurethanes include aromatic hydrocarbons such as toluene and xylene, ketones such as methyl ethyl ketone and methyl isobutyl ketone, alcohols such as isopropyl alcohol, normal butyl alcohol, monoethers of glycols such as CELLOSOLVES® and CARBITOLS®, water and mixtures thereof.

When water is employed as a diluent either alone or in admixture with water-miscible solvents, the compositions of the invention should be modified so that they are dispersible in the aqueous diluent. This can be accomplished by the use of externally added emulsifiers incorporating water-solubilizing groups such as ethylene oxide moieties or ionic salt groups into one or more components of the present invention. Examples of suitable ionic salt groups are:

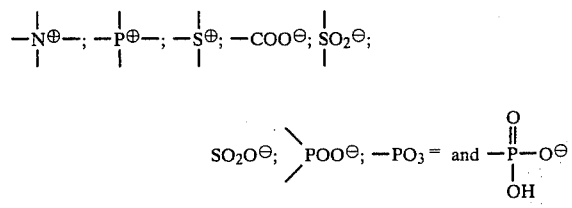

The ionic salt groups can be incorporated into the components of the coating composition by techniques well known in the art. They may be present in the polymeric polyol; for example, where the polymeric polyol is a polyester or an acrylic, it can easily be prepared with unreacted acid groups which can then be neutralized to form acid salt groups. Alternately, the ionic salt groups can be incorporated by techniques disclosed in U.S. patent applications Ser. Nos. 582,946, and 583,085, filed June 2, 1975, both to Scriven and Chang, and in U.S. No. Pat. No. 3,479,310 to Dieterich et al.

Aqueous polyurethanes are preferred in the practice of the invention because they contain no or relatively small amounts of organic solvent making them easier to handle and more amenable to environmental requirements. In addition, aqueous polyurethanes, particularly those described in the aforementioned Scriven and Chang patent applications have outstanding mechanical properties making them particularly efficient as implosion protective coatings.

In addition to the polyurethane and diluents, the coating composition can contain optional ingredients such as pigments, colorants, anti-oxidants, flow control agents, surfactants, adhesion control agents and other formulating additives if desired.

The polyurethanes prepared as described above and employed as films have mechanical properties which makes them particularly effective for forming implosion protective films. The tensile strengths and elongation of the polyurethanes can be prepared with particularly high values. Typical polyurethane films prepared in accordance with the invention have tensile strengths of at least 500, usually 500 to 15,000, preferably 1000 to 15,000 and most preferably 2500 to 15,000 pounds per square inch and elongations of at least about 50, usually 50 to 1500, preferably 150 to 1500 and most preferably 200 to 1500 percent when a dry polyurethane film of about 1.0 to 2.5 mils thickness is subjected to tensile testing according to ASTM D-638-72. Preferably for better glass retaining properties even under violent imploding conditions such as occurs with television tubes, the polyurethane films will have tensile strengths of at least 1000 psi and elongations of at least 100 percent and more preferably tensile strengths of at least 2500 psi and elongations of at least 150 percent. However, it should be appreciated that films having less than the minimum elongations (as determined by the above-described procedure) can be used in certain applications, for example, where implosion conditions are not violent and where films thicker than 2.5 mils can be used. Examples of such films are the thermosetting polyurethanes which, although having high tensile strengths, that is, at least 500 pounds per square inch, when tested in accordance with the above procedure, have relatively low elongations. However, films prepared from such polyurethanes will have sufficient glass retaining properties, if used as thicker coatings, or used for applications where the force of implosion is relatively low, such as fluorescent lamps.

For certain applications such as television tubes, adhesion of the polyurethane film to the surface of the glass enclosure is also important. Polyurethane films secured to the exterior surface of evacuated glass enclosures with a controlled low degree of adhesion seem to have better glass retaining properties than films more tightly bonded to the glass surface. Accordingly, in those applications where a controlled low degree of adhesion is desired, an adhesion inhibitor such as stearyl acid phosphate can be added to the polyurethane coating composition. By a controlled low degree of adhesion is meant that the polyurethane coating will adhere to glass with a 90° peel strength of less than about 20 pounds per lineal inch and preferably from about 10 to 0.5 pounds per lineal inch as measured by a Chatillon hand tester. This tester is manufactured by John Chatillon and Son, Model DPP-25, Ser. No. 6671. The instrument is described in some detail in U.S. Pat. No. 3,165,925. The degree of adhesion is determined by pulling the polyurethane away from the glass surface at a 90° angle to the glass surface.

Besides a controlled low degree of adhesion, there are conditions, such as high humidity, where a high degree of adhesion is desirable. In these situations, an adhesion promoter such as an organo silane, for example, gamma-glycidoxy-propyltrimethoxysilane can be used. Also, mixtures of adhesion inhibitors and promoters can be used.

The polyurethane film can be applied to the exterior surface of the evacuated glass enclosures by conventional methods including applying a liquid polyurethane coating composition to the glass enclosure by brushing, dipping, flow coating and spraying. In addition, a polyurethane film can be preformed and applied to the glass enclosure by lamination, heat shrinking or by the use of an adhesive.

The polyurethane film thickness will vary somewhat depending upon the type of glass enclosure. In general, coatings from about 0.2 to 20 mils have been found to be useful in most applications.

It is not necessary that the film cover the entire exterior surface, although the entire surface can be covered if desired. With television tubes, excellent implosion protection is obtained by the film covering only part of the area of the tube. This is shown in Example 2 and Table I which follow.

After the film has been applied, it is cured, which can be at room temperature or alternately at elevated temperature, as high as 400° C. for short periods of time. The coating can also be cured with microwave and/or infrared radiation.

EXAMPLE A

An aqueous-based polyurethane dispersion was prepared from the following charge:

| Ingredient | Parts by Weight |
|---|---|
| N-methyl-2-pyrrolidone | 68.8 |
| dimethylolpropionic acid | 13.5 |
| neopentyl glycol | 8.3 |
| poly(1,4-butanediol adipate)[1] | 100.0 |
| dibutyltin dilaurate[2] | 0.08 |
| 4,4'-methylene-bis(cyclohexyl isocyanate)[3] | 102.1 |
| dimethylethanolamine | 7.7 |
| deionized water | 307.2 |
| hydrazine hydrate | 5.85 |
| acetyl acetone | 1.2 |

[1]Polyester having a molecular weight of about 1000 commercially available from Witco Chemical Company as FORMREZ F13-35.
[2]Urethane-forming catalyst.
[3]Commercially available from E. I. DuPont de Nemours and Company as HYLENE W.

The poly(1,4-butanediol adipate) was charged to a suitable reaction vessel along with the dimethylolpropionic acid, neopentyl glycol, HYLENE W, dibutyltin dilaurate and N-methyl-2-pyrrolidone solvent. The reaction mixture was heated to 83° C. under a nitrogen atmosphere over a 4½ hour period and then cooled to room temperature. The resulting product had an NCO equivalent of approximately 1100 and contained about 75 percent by weight total solids.

The acid-containing prepolymer was dispersed in water and chain extended as follows. The dimethylethanolamine neutralizer and deionized water were charged to a suitable reaction vessel and stirred to form a solution. The acid-containing, NCO-containing polymer solution prepared as described immediately above was added to the amine solution to neutralize (100 percent theoretical neutralization) and disperse the prepolymer. The hydrazine hydrate chain extender as an 85 percent by weight aqueous solution was then added followed by thinning the reaction mixture with the acetyl acetone. The resulting polyurethane dispersion was stable and contained a total solids content of about 38 percent and had a Brookfield viscosity of approximately 600 centipoises at 20 rpm's, number 5 spindle.

When the dispersion was deposited as a film and dried for 30 minutes at 250° F. (121° C.) (dry film thickness of 1 to 2½ mils), the film had 370 percent elongation to break and 4100 psi tensile strength.

EXAMPLE B

An aqueous-based polyurethane dispersion was prepared from the following charge:

| Ingredient | Parts by Weight |
|---|---|
| N-methyl-2-pyrrolidone | 2080.5 |
| deionized water | 4.2 |
| polyoxytetramethylene glycol (molecular weight = 1000) | 3617.1 |
| toluene diisocyanate | 2600.6 |
| dimethylolpropionic acid | 459.7 |
| neopentyl glycol | 212.4 |
| deionized water | 9191.0 |
| hydrazine water | 163.0 |
| dimethylethanolamine | 278.5 |

-continued

| Ingredient | Parts by Weight |
|---|---|
| acetyl acetone | 33.7 |

The N-methyl-2-pyrrolidone, first portion of deionized water, polyoxytetramethylene glycol and toluene diisocyanate were blended and charged to a reaction vessel followed by the addition of dimethylolpropionic acid and neopentyl glycol. The reaction mixture was heated to 70° C. under a nitrogen atmosphere for a total of 3½ hours to reach an NCO equivalent of approximately 1090.

The NCO-prepolymer was then added, over a period of 15 minutes, to a flask containing the second portion of deionized water, the hydrazine hydrate (64 percent aqueous solution) and the dimethylethanolamine to form the chain-extended dispersed polymer. The dispersion was finally thinned with the acetyl acetone to give the final polyurethane dispersion which had a total solids content of about 33 percent and a Brookfield viscosity of approximately 274 centipoises at 50 rpm's, number 5 spindle.

When the dispersion was deposited as a film and dried for 30 minutes at 250° F. (121° C.), dry film thicknesses of 1 to 2½ mils, the film had 580 percent elongation to break and 7200 psi tensile strength.

EXAMPLE 1

A funnel-shaped 150 watt evacuated flood lamp was coated with the aqueous polyurethane dispersion A. Coating was by spray application so as to produce a film of about 1 to 1.5 dry film thickness. The film was dried for 30 minutes at 125° C. The effectiveness of the film was demonstrated by dropping the coated lamps onto a concrete floor from approximately four feet. Although the glass broke, no sharp edges were exposed, the glass did not scatter and the polyurethane coating maintained the general shape of the lamp.

EXAMPLE 2

A number of evacuated television tubes were coated with the aqueous polyurethane dispersion B by a variety of methods in different positions over the tubes. (See attached Table I.) This was done to determine the effectiveness of the resultant film on partially coated tubes. The method of testing consisted of impacting the front of the tube with a round metal hammer with varying degrees of force. The amount and size of the glass fragments projected in the forward direction or from the same direction that the impact hammer came from was then measured.

TABLE I

Implosion Urethane Coatings on Television Tubes

| Tube Type | Coated Area | Film Application Method | Dry Film Thickness, in mils | Auxiliary Implosion Protection | Implosion Method | Implosion Test Results |
|---|---|---|---|---|---|---|
| 19 inch/90°[1] | panel face and side walls | brush | 5 to 6 | none | 20 foot-pounds | no glass thrown |
| 25 inch/100° | funnel neck to T-band[2] | brush | 1 to 2 | single T-band 1000 pound tension | 15 foot-pounds | passed[4] |
| 19 inch/90° | funnel neck to panel eyebrow[3] | flow | 4 to 7 | none | 15 foot-pounds | passed |
| 19 inch/90° | funnel neck to panel eyebrow | brush | 4 to 6 | none | 15 foot-pounds | passed |
| 19 inch/90° | panel face and side wall | flow on face, brush on side wall | about 2½ | none | 20 foot-pounds | no glass thrown |
| 19 inch/90° | panel face and side wall | spray | about 3 | none | 15 foot-pounds | passed |

[1]With regard to the tube type, the first number indicates the length of a diagonal line over the viewing area of the tube in inches and the angle indicates the degree of tapering of the funnel-shaped portion of the tube.
[2]A T-band is a metal band under tension positioned around the eyebrow of the tube to provide a compressive force on that portion of the tube.
[3]The eyebrow area of the television tube is between the face and funnel neck.
[4]In the implosion testing, a pass rating indicates minimum amount of glass projected in forward direction as described in Underwriters' Laboratories Test U.L. 1418.

We claim:

1. An implosion protected evacuated glass enclosure which comprises in combination:
   (A) a sealed evacuated glass enclosure having exterior and interior surfaces, through at least a portion of said surfaces light is transmitted; and
   (B) a transparent, non-tacky, scratch-resistant, polyurethane film on the exposed exterior surface of said glass enclosure having a low degree of adhesion to the exterior surface of said sealed evacuated glass enclosure, said low degree of adhesion being such that said polyurethane film adheres to said glass surface with a 90° peel strength of less than about 20 pounds per lineal inch and the mechanical properties of the polyurethane film are such that when a free film of approximately 1 to 2.5 mils is subjected to tensile testing according to ASTM D-638-72, the film exhibits a tensile strength of from about 1000 to 15,000 pounds per square inch and a corresponding elongation of from about 150 to 1500 percent.

2. The glass enclosure of claim 1 in the form of a cathode ray tube.

3. The glass enclosure of claim 2 in the form of a television tube.

4. The glass enclosure of claim 1 in the form of an electric lamp.

5. The glass enclosure of claim 4 in the form of a fluorescent lamp.

6. The glass enclosure of claim 1 in which the polyurethane is a thermoplastic polyurethane.

7. The glass enclosure of claim 1 in which the polyurethane is a poly(ester-urethane) or a poly(ether-urethane).

8. The glass enclosure of claim 1 in which the polyurethane is a thermosetting polyurethane.

9. The glass enclosure of claim 1 in which the polyurethane film has a thickness of from about 0.2 to 20 mils.

10. The glass enclosure of claim 1 in which the polyurethane film is deposited from an aqueous dispersion of a polyurethane.

11. The glass enclosure of claim 1 in which the polyurethane contains an adhesion control agent selected from the class consisting of adhesion inhibitors, adhesion promoters and mixture thereof.

* * * * *